US007473004B1

(12) United States Patent
Tsai

(10) Patent No.: US 7,473,004 B1
(45) Date of Patent: Jan. 6, 2009

(54) LIGHT-EMITTING HEAD DECORATION

(76) Inventor: Tien-Chun Tsai, No. 568-2, Jhongsiao Rd., East District, Chiayi City (TW)

( * ) Notice: Subject to any disclaimer, the term of this patent is extended or adjusted under 35 U.S.C. 154(b) by 0 days.

(21) Appl. No.: 11/984,695

(22) Filed: Nov. 21, 2007

(51) Int. Cl.
*F21V 21/084* (2006.01)

(52) U.S. Cl. ..... 362/104; 362/105

(58) Field of Classification Search ..... 362/103, 362/104, 105, 106, 237, 240, 244, 252, 806; 63/3, 27, 40; 2/171, 173.5, 181.2
See application file for complete search history.

(56) References Cited

U.S. PATENT DOCUMENTS 4,604,760 A * 8/1986 Coin ..... 2/171
4,999,747 A * 3/1991 Chen ..... 63/3
6,223,355 B1 * 5/2001 Irving ..... 362/106

* cited by examiner

*Primary Examiner*—Y My Quach Lee
(74) *Attorney, Agent, or Firm*—Rosenberg, Klein & Lee

(57) ABSTRACT

The present invention relates to a light-emitting head decoration, comprising: a mount unit (1) provided with a groove (11) having a plurality of mounting seats (12) and retaining slots (13) inside; an ornamental unit (2) with a predetermined aesthetical design which has a light-emitting circuit (3) thereon, an inserting segment (27) provided at the bottom of the ornamental unit (2) is inserted into the groove (11), a plurality of receiving slots (271) are provided on the inserting segment (27), and each receiving slot (271) has respective light source (33) which is connected to the light-emitting circuit (3), each receiving slot (271) matches with respective mounting seat (12) and several hooks (28) are provided on the bottom edge of the inserting segment (27) for inserting into the retaining slots (13) so as to hold the ornamental unit (2) on the mount unit (1).

9 Claims, 4 Drawing Sheets

LIGHT-EMITTING HEAD DECORATION

BACKGROUND OF THE INVENTION

1. Field of the Invention

The present invention relates to a light-emitting head decoration, particularly to a decoration which can emit light and can be put on head.

2. Brief Description of the Prior Art

So far, the head decoration sold on the market is purely of aesthetical design without light-emitting effect. Thus, ordinary head decoration can only be designed in appearance only so that the variation of head decoration is quite limited. Even this ordinary head decoration has a distinct aesthetical design, but it is unable to be highlighted in the dark occasion due to the lack of light emission.

In view of the above defect happened in prior art, the inventor thus proposes a new light-emitting head decoration according to continuous devotion to the product development and design based on the experience and the knowledge accumulated in the long term involvement of relevant field.

SUMMARY OF THE INVENTION

The main object of this invention is to provide a novel structure of light-emitting head decoration which can emit light and can be put on head.

The above object and its effectiveness can be realized by the light-emitting head decoration of the present invention, in which:

the light-emitting head decoration comprises: a mount unit provided with a groove having a plurality of mounting seats and retaining slots inside; an ornamental unit with a predetermined shape design which has a light-emitting circuit thereon, an inserting segment provided at the bottom of the ornamental unit is inserted into said groove, a plurality of receiving slots are provided on said inserting segment, and each receiving slot has respective light source which is connected to the light-emitting circuit, each receiving slot matches with respective mounting seat and several hooks extending downward are provided on the bottom edge of the inserting segment for inserting into the retaining slots so as to hold the ornamental unit on the mount unit.

Furthermore, the light-emitting head decoration of the present invention includes a plurality of comb teeth extending downward which are provided at both ends of the mount unit.

Moreover, the light-emitting head decoration of the present invention has its ornamental unit be designed with a crown shape and a light source is provided with respect to each jewel-design area of the crown, and the light source is electrically connected to a light-emitting circuit.

Furthermore, the light-emitting head decoration of the present invention includes a cap body disposed on the location where the light-emitting circuit is provided on the ornamental unit, so that the light-emitting circuit is clamped between the ornamental unit and the cap body.

The tapped-hole bosses provided on the ornamental unit, the corresponding through holes provided on the cap body, and the bolts passing the through holes and fastened within the tapped-holes of the bosses form the means for combining the ornamental unit and the cap body.

Moreover, the light-emitting head decoration of the present invention includes covers provided at the location where the light sources are provided on the ornamental unit so as to enclose the light source between the ornamental unit and the covers.

The recessed holes provided on the ornamental unit and the projecting bosses provided on the covers form the means of combination in such a manner that the projecting bosses are correspondingly engaged within the recessed holes at the time of mutual combination between the ornamental unit and the covers.

Furthermore, the light-emitting head decoration of the present invention includes a switch provided in the light-emitting circuit, and the light emission state, such as ON/OFF, continuous irradiation or flickering of each light source is controlled by the number of press down of the switch.

BRIEF DESCRIPTION OF THE DRAWINGS

The present invention will be better understood by the detailed description of preferred embodiments with reference to the accompanied drawings, in which.

DETAILED DESCRIPTION OF THE PREFERRED EMBODIMENTS

The technical content, objects and effectiveness of the present invention will become more apparent by the detailed description in conjunction with the accompanying drawings.

Figure 1:
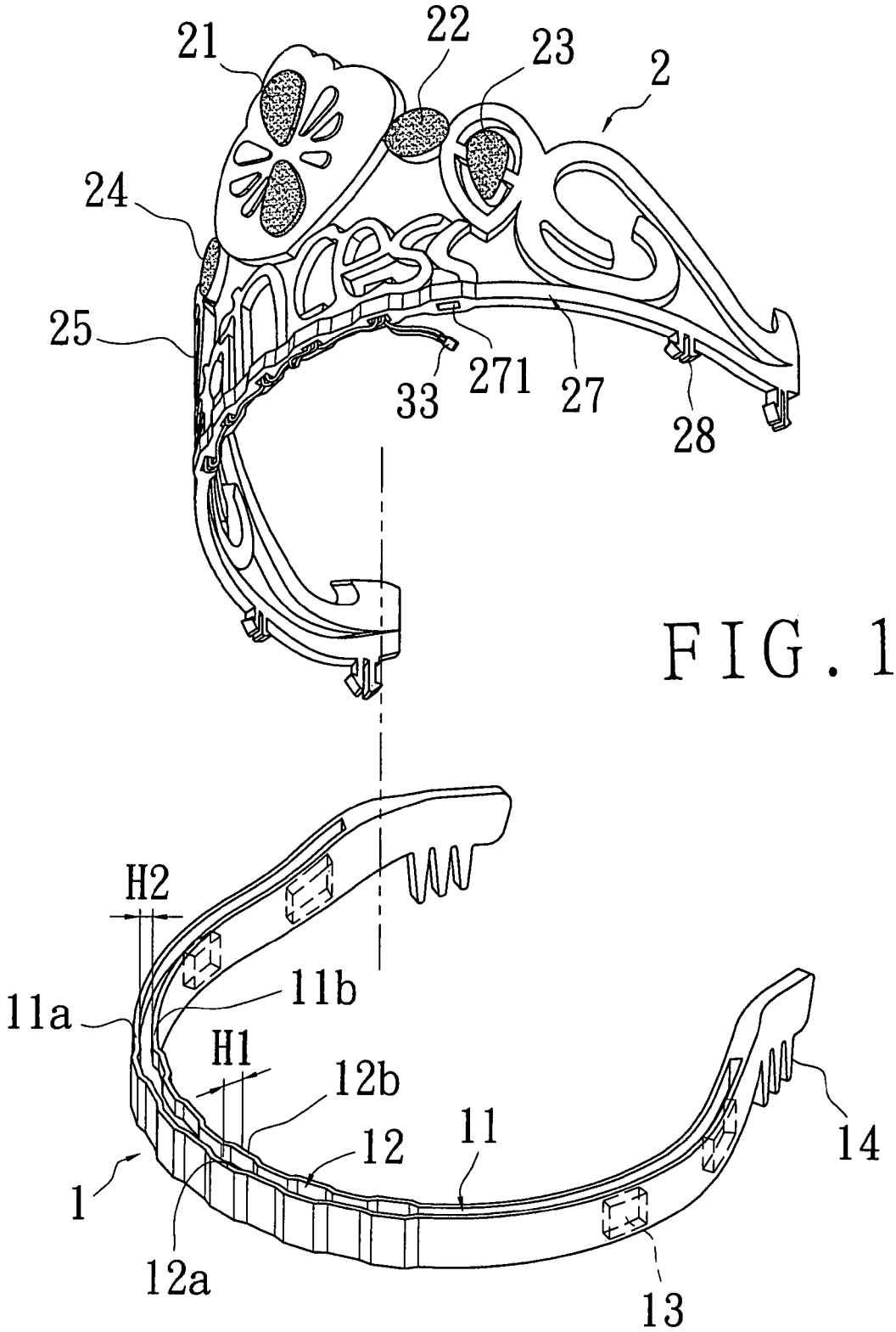
FIG. 1 is a perspective exploded view of the present invention.
Figure 2:
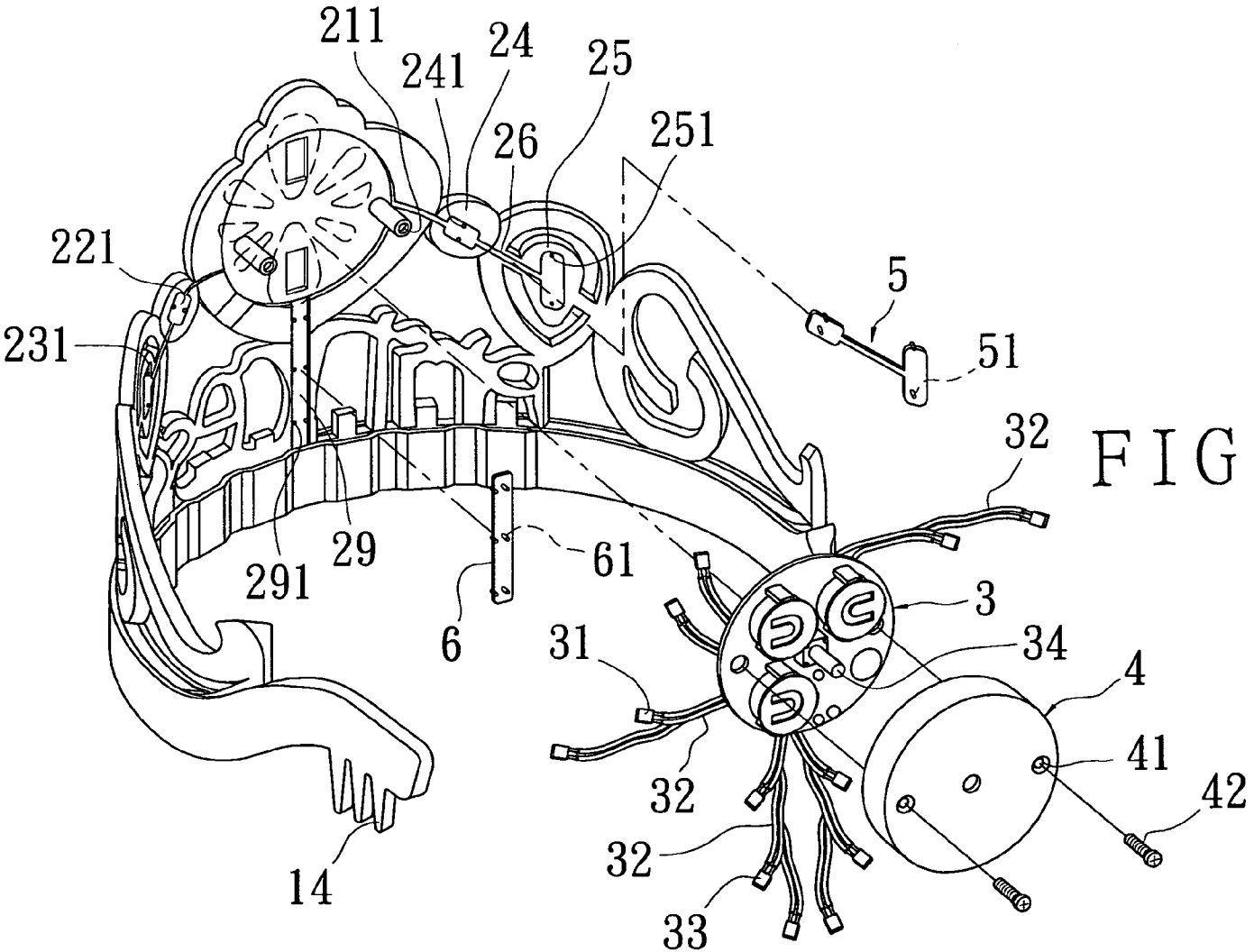
FIG. 2 is another perspective exploded view of the present invention.
Figure 3:
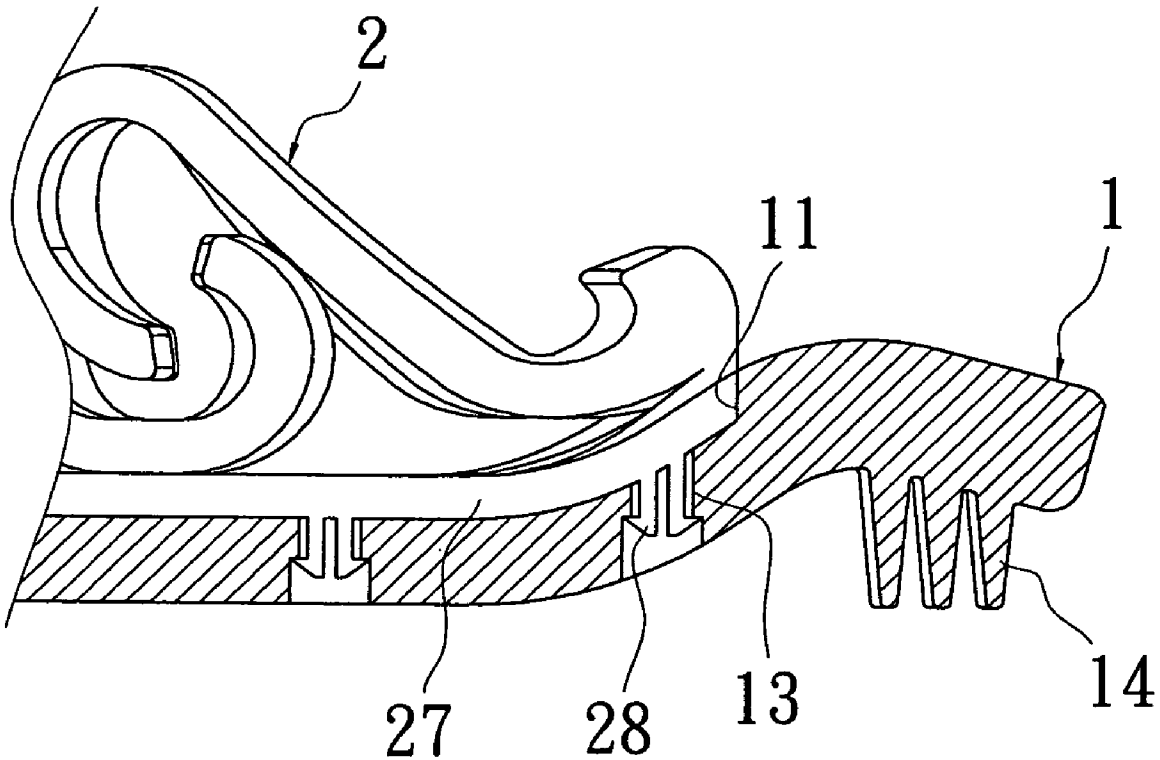
FIG. 3 is an assembled sectional view of the present invention.
Figure 4:
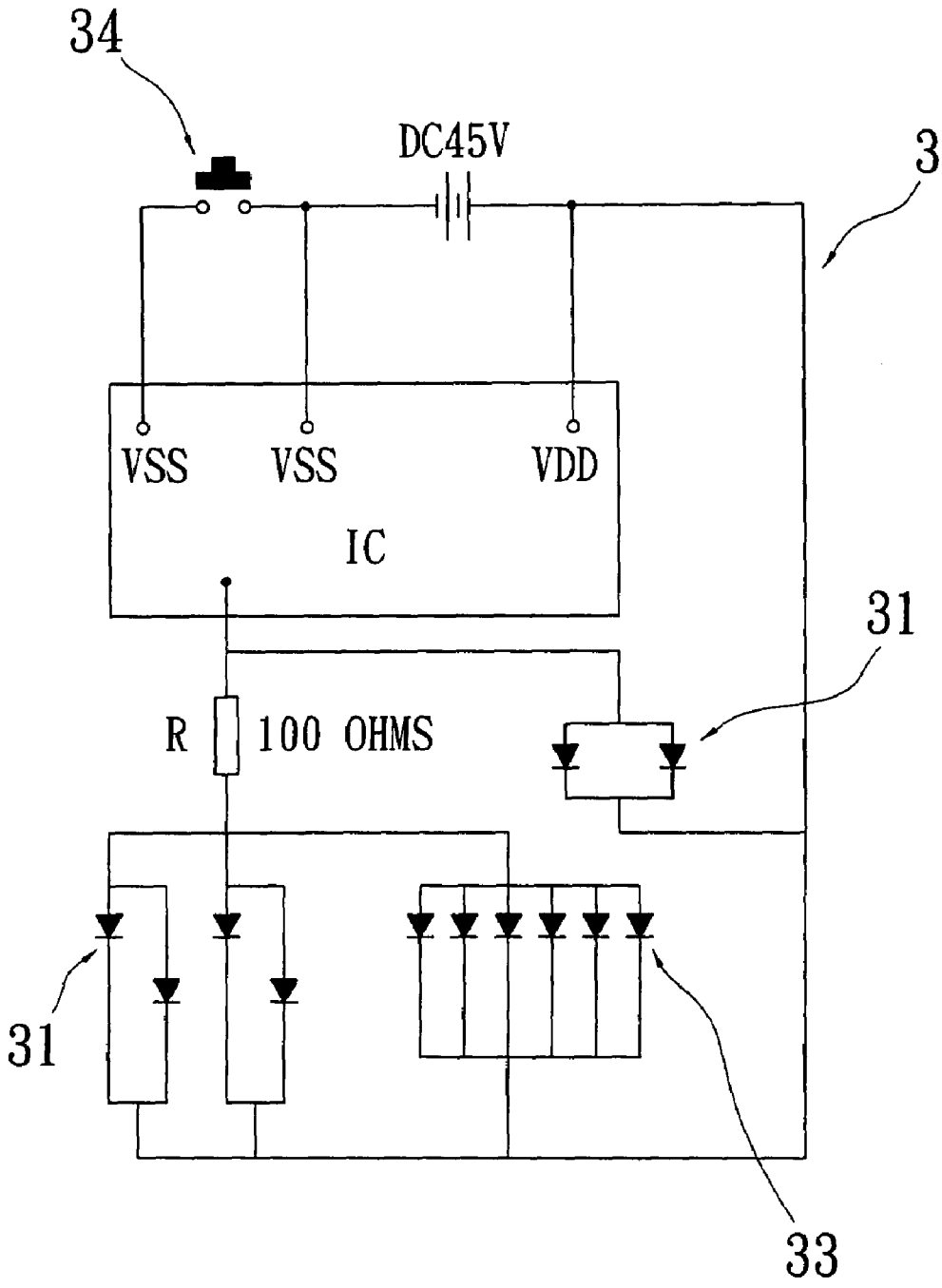
FIG. 4 is a circuit diagram of the present invention.

Firstly referring to FIGS. 1 to 4, the light-emitting head decoration of the present invention comprises a mount unit (1) and an ornamental unit (2).

The mount unit (1) is a curved strap body, on which a groove (11) with upward opening is provided. A plurality of mounting seats (12) and retaining slots (13) are provided within the groove (11). The distance (H1) between the two wall faces (12*a*), (12*b*) of the mounting seats (12) is larger than the distance (H2) between the two wall faces (11*a*), (11*b*) of the groove (11). The retaining slots (13) penetrate downward through the mount unit (1). A plurality of comb teeth (14) extending downward are provided at both ends of the mount unit (1).

The ornamental unit (2) is designed with a crown-shape appearance, on which a plurality of jewel-design areas (21~25) are provided. A light source (31) is provided for each of the jewel-design areas (21~25), and each light source (31) is electrically connected to a light-emitting circuit (3) within the first jewel-design area (21). Then, a cap body (4) is provided on the first jewel-design area (21), which is used to enclose the light-emitting circuit (3) and the light source (31) provided on the first jewel-design area (21) between the ornamental unit (2) and the cap body (4). The tapped-hole bosses (211) provided on the first jewel-design area (21), the corresponding through hole (41) provided on the cap body (4), and the bolts (42) penetrating the through hole (41) and fastened within the tapped-holes of the bosses (211) form the means for combining the ornamental unit (2) and the cap body (4). Furthermore, lead-wire guiding grooves (26), (29) are provided between neighboring jewel-design areas (21~25) and below the first jewel-design area (21) for accommodating the lead wires (32) which are connected between each light source (31) and the light-emitting circuit (3). Moreover, the lead-wire guiding grooves (26) between the second jewel-design area (22) to the third jewel area (23) and the fourth jewel-design area (24) to the fifth jewel area (25) are combined respectively with a cover (5) such that the light sources (31) provided in each of the jewel-design areas (22~25) and the lead wires (32) received within the lead-wire guiding grooves (26) are enclosed between the ornamental unit (2) and the covers (5). The recessed holes (221, 231, 241, 251) provided on the jewel-design areas (22~25) of the ornamental unit (2) and the projecting bosses (51) provided on the covers (5) forms the means of combination in such a manner that the projecting bosses (51) is correspondingly engaged within the recessed holes (221, 231, 241, 251) at the time of mutual combination between the jewel-design areas (22~25) and the covers (5). Similarly, the lead-wire guiding groove (29) below the first jewel-design area (21) is combined with a cover (6) such that the lead wires (32) received within the lead-wire guiding groove (29) are enclosed between the ornamental unit (2) and the cover (6). The recessed holes (291) provided on the lead-wire guiding groove (29) of the ornamental unit (2) and the projecting bosses (61) provided on the cover (6) form the means of combination in such a manner that the projecting bosses (61) are correspondingly engaged within the recessed holes (291) at the time of mutual combination between the ornamental unit (2) and the cover (6). On the other hand, an inserting segment (27) is provided at the bottom of the ornamental unit (2), which is correspondingly inserted into the groove (11) of the mount unit (1). A plurality of receiving slots (271) with downward openings are provided on the inserting segment (27), and each receiving slot (271) has respective light source (33) which is connected to the light-emitting circuit (3). Each receiving slot (271) matches with respective mounting seat (12) of the mount unit (1) such that each receiving slot (271) engages with respective mounting seat (12) of the mount unit (1) after the inserting segment (27) of the ornamental unit (2) is inserted into the groove (11) of the mount unit (1). Several hooks (28) extended downward are provided on the bottom edge of the inserting segment (27) of the ornamental unit (2). Each hook (28) can be inserted and locked within the corresponding retaining slot (13) of the mount unit (1).

When assembling, each light source (31) and the light-emitting circuit (3) are respectively assembled on each of the jewel-design areas (21~25), and the projecting bosses (51) on the covers (5) are engaged with the recessed holes (221, 231, 241, 251) on the jewel-design areas (22~25) such that each of the light sources (31) provided on the jewel-design areas (22~25) respectively and the lead wire (32) received within the lead-wire guiding grooves (26) are enclosed between the ornamental unit (2) and the cover (5). Then, after the cap body (4) is covered with respect to the first jewel-design areas (21), the bolts (42) are penetrated the through hole (41) and fastened within the tapped-holes of the bosses (211) such that the light-emitting circuit (3) and the light source (31) provided on the first jewel-design area (21) is enclosed between the ornamental unit (2) and the cap body (4). Subsequently, the projecting bosses (61) provided on the cover (6) are correspondingly inserted into the recessed holes (291) provided on the lead-wire guiding groove (29) of the ornamental unit (2) such that the lead wires (32) of the light sources (33) are received between the ornamental unit (2) and the cover (6). Then, each receiving slot (271) of the ornamental unit (2) is provided with a light source (33), and the inserting segment (27) is correspondingly inserted into the groove (11) of the mount unit (1). Each receiving slot (271) of the ornamental unit (2) matches with respective engagement section (12) of the mount unit (1) such that each receiving slot (271) engages with respective mounting seat (12) of the mount unit (1) after the inserting segment (27) of the ornamental unit (2) is inserted into the groove (11) of the mount unit (1). In such a manner, the hooks (28) provided on the bottom edge of the inserting segment (27) can be inserted and locked within respective retaining slots (13) of the mount unit (1) so as to achieve concrete combination between the ornamental unit (2) and the mount unit (1).

Then, user can wear the light-emitting heat decoration on the head such that the plural comb tooth (14) extending downward and provided at both ends of the mount unit (1) are inserted into the hair so as to be fixed on the head of user. Inasmuch as the light sources (31) are provided on the jewel-design areas (21~25) respectively and the light source (33) is provided in each receiving slot (271) of the ornamental unit (2), the light-emitting heat decoration of the present invention has brilliant light-emitting effect.

Furthermore, a switch (34) can be provided in the light-emitting circuit (3) of the light-emitting heat decoration of the present invention such that control of the state of light emission, such as ON-OFF, continuous irradiation or flickering of each light source (31, 33) can be conducted by the number of press-down of the switch (34).

Summing up above, the embodiment of this invention can reach expected effectiveness, and the specific configurations disclosed herein have yet not seen in the prior art of the same category of product, even has not been opened to the public before application.

Additional advantages and modifications will readily occur to those skilled in the art. Therefore, this invention in its broader aspects is not limited to the specific details and representative embodiment shown and described herein. Accordingly, various modifications and variations may be made without departing from the spirit and scope of the general inventive concept as defined by the appended claims and their equivalents.

What is claimed is:

1. A light-emitting head decoration, comprising:

a mount unit (1) provided with a groove (11) having a plurality of mounting seats (12) and retaining slots (13) inside the groove;

an ornamental unit (2) having a crown-shape appearance, on which a plurality of jewel-design areas (21~25) are provided, each of the jewel-design areas (21~25) having a corresponding light source (31); one of the jewel-design area (21~25) connected to a light-emitting circuit (3) electrically connected to each light source (31); an inserting segment (27) provided at a bottom of the ornamental unit (2), and inserted into said groove (11) of said mounting unit; a plurality of receiving slots (271) formed in said inserting segment (27), and each receiving slot (271) having respective light source (33) which is connected to the light-emitting circuit (3); each receiving slot (271) corresponding with respective mounting seat (12) of said mounting unit and several hooks (28) are formed on a bottom edge of the inserting segment (27) for inserting into said retaining slots (13) so as to hold the ornamental unit (2) on the mount unit (1).

2. A light-emitting head decoration as claimed in claim 1, wherein a plurality of comb teeth (14) extending downward are formed at both ends of the mount unit (1).

3. A light-emitting head decoration as claimed in claim 1, wherein a cap body (4) is disposed on the light-emitting circuit (3) and connected to the ornamental unit (2).

4. A light-emitting head decoration as claimed in claim 3, wherein a plurality of tapped-hole bosses (211) are formed on the ornamental unit (2), a plurality of corresponding through holes (41) are formed in the cap body (4), and a plurality of bolts (42) respectively pass through the through holes (41)

and are fastened within the tapped-holes of the bosses (211) to combine the ornamental unit (2) and the cap body (4).

5. A light-emitting head decoration as claimed in claim 1, wherein lead-wire guiding grooves (26) are provided between neighboring jewel-design areas (22~25), said lead-wire guiding grooves (26) are combined with covers (5) covering the light sources (31) and the lead-wire guiding grooves (26) such that the light sources (31) and lead wires (32) of the light emitting circuit are enclosed between the ornamental unit (2) and said covers (5).

6. A light-emitting head decoration as claimed in claim 1, wherein a plurality of recessed holes are (221, 231, 241, 251) provided on the ornamental unit (2) and a plurality of projecting bosses are (51) provided on the covers (5) such that the projecting bosses (51) are correspondingly engaged within the recessed holes (221, 231, 241, 251) of the ornamental unit (2).

7. A light-emitting head decoration as claimed in claim 1, wherein a lead-wire guiding groove (29) provided below one of the jewel-design areas is combined with a cover (6) such that lead wires (32) of the light emitting circuit are received between the ornamental unit (2) and the cover (6).

8. A light-emitting head decoration as claimed in claim 7, wherein a plurality of recessed holes (291) provided on the lead-wire guiding groove (29) of the ornamental unit (2) and a plurality of projecting bosses (61) provided on the cover (6) such that the projecting bosses (61) are correspondingly engaged within the recessed holes (291) of the lead wire guiding groove to combine the ornamental unit (2) and the cover (6).

9. A light-emitting head decoration as claimed in claim 1, wherein a switch (34) is provided in the light-emitting circuit (3), and the light emission state of each light source is controlled by the number of press-down of said switch.

* * * * *